United States Patent [19]

Grants

[11] 4,164,209

[45] Aug. 14, 1979

[54] INTERNAL COMBUSTION ENGINE CYLINDER VALVE ASSEMBLY

[76] Inventor: William V. Grants, 1244 Sunnyside Dr., Berkeley, Ill. 60163

[21] Appl. No.: 804,672

[22] Filed: Jun. 8, 1977

[51] Int. Cl.[2] ..... F01L 3/10

[52] U.S. Cl. ..... 123/188 AP; 123/188 B; 123/81 B; 123/188 M

[58] Field of Search ..... 123/90.28, 81 R, 81 B, 123/188 B, 188 R, 188 AP, 188 M, 188 S; 251/298

[56] References Cited

U.S. PATENT DOCUMENTS

| | | | |
|---|---|---|---|
| 1,542,617 | 6/1925 | Guy et al. | 123/81 B |
| 1,988,018 | 1/1935 | Peterson | 123/188 AP |
| 2,622,574 | 12/1952 | Butterworth | 123/90.24 |
| 2,874,686 | 2/1959 | Carey, Jr. | 123/81 |
| 3,299,869 | 1/1967 | Sichlesteel | 123/188 S |
| 3,539,150 | 11/1970 | Conrad | 251/298 |
| 3,875,921 | 4/1975 | Deboy et al. | 123/188 AP |

FOREIGN PATENT DOCUMENTS

| | | | |
|---|---|---|---|
| 970490 | 9/1958 | Fed. Rep. of Germany | 123/188 AP |

*Primary Examiner*—Charles J. Myhre
*Assistant Examiner*—D. Reynolds
*Attorney, Agent, or Firm*—Bernard L. Kleinke

[57] ABSTRACT

A valve assembly for an internal combustion engine having a cylinder head including a combustion chamber and an induction passage terminating at a valve seat defining an inlet port to the combustion chamber in the combustion side of the cylinder head, includes a valve head fitting over and engaging sealingly the valve seat. Mounting means disposed inside of the combustion chamber in the combustion side of the cylinder head connects swingably the valve member to the valve head between a closed position in sealing engagement with the valve seat and an open position substantially out of alignment with the valve seat. A valve stem is reciprocatively journaled in a stem guide bore with one end of the valve stem extending from the cylinder head and its other end connected to the valve head. The axis of the induction passage is substantially parallel to the axis of the combustion chamber to further facilitate an increased volumetric efficiency. The mounting means for the valve head is disposed between the induction passage and an exhaust passage so that when the valve head for the induction passage swings to its open position, it is disposed between and in blocking relationship with the exhaust passage.

10 Claims, 1 Drawing Figure

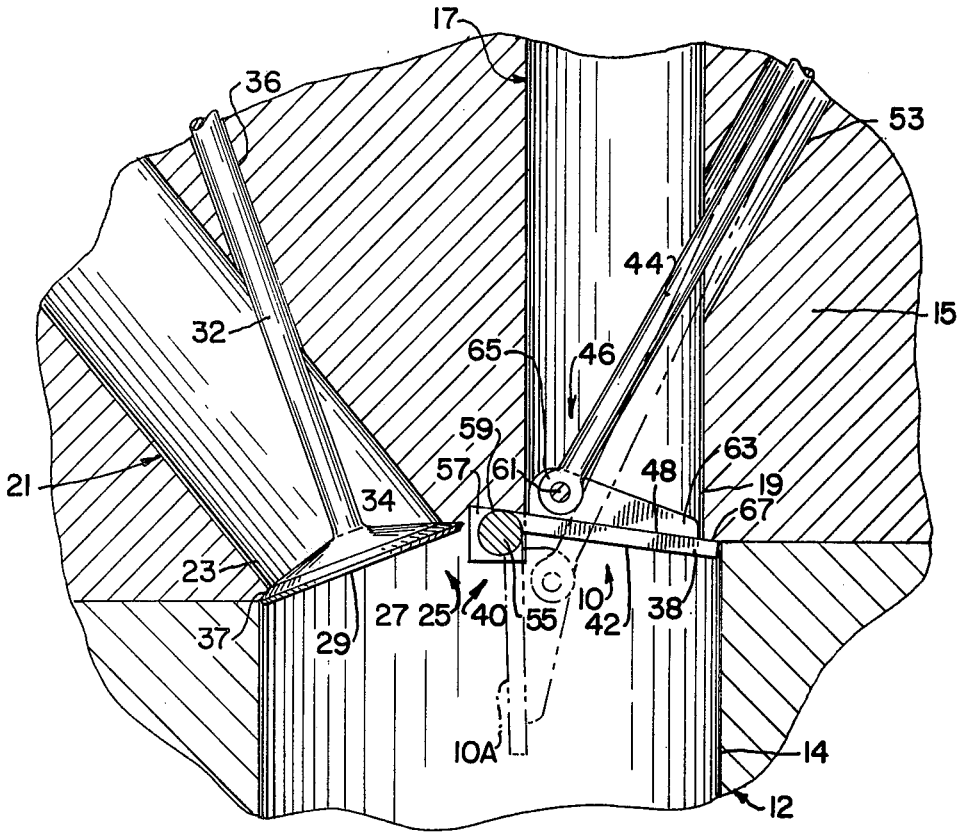
17
36
53
44
15
32
65
46
59
63
21
57
61
48
19
34
67
23
10
27
25
40
55
42
38
37
29
10A
14
12

INTERNAL COMBUSTION ENGINE CYLINDER VALVE ASSEMBLY

The present invention relates in general to an internal combustion engine intake valve assembly, and it more particularly relates to such a valve assembly which greatly increases the volumetric efficiency of an internal combustion engine.

Many different types and kinds of internal combustion engine cylinder valve assemblies, such as intake valve assemblies, have been employed in the past. For example, reference may be made to the following United States patents and the references cited therein: U.S. Pat. Nos. 1,988,018 and 3,875,921. The intake valve disclosed in U.S. Pat. No. 3,875,921 is a poppet valve, which when disposed in its fully open position, has its valve head disposed within the piston cylinder substantially in alignment with the intake port. As a result, the valve head presents an obstruction to the flow of fluids entering into the piston cylinder. Therefore, where greater volumetric efficiency is required, such as is the case in a racing engine, the so-called "Butterworth" valve is employed. The prior art Butterworth valve is formed with a curved swan-neck arm mounted on a shaft, which is carried in bearings in the cylinder head. A co-axial torsion spring assembly controls the operation of the shaft. When the valve is moved to its fully opened position, the curved arm swings into a recess formed in the side of the induction passage so that the only obstruction to flow in the port is the arm of the valve. However, when in its fully open position, the valve head is disposed in the piston cylinder and has its axis disposed parallel to the axis of the piston cylinder whereby the valve head presents a substantial obstruction to the flow of fluid entering the piston cylinder. Therefore, it would be highly desirable to have a valve assembly, which when fully open, presents a substantially smaller obstruction to the flow of fluid to thereby increase greatly the volumetric efficiency of the operation. Also, such a new valve assembly should have substantially smaller heat losses as compared to conventional valve assemblies.

Therefore, it is the principal object of the present invention to provide a new and improved valve assembly, which greatly improves volumetric efficiency by greatly reducing the obstruction to the flow of fluids when the valve is disposed in its fully open position, and which substantially decreases heat losses and increases the volumetric efficiency of the operation.

Briefly, the above and further objects of the present invention are realized by providing a new and improved valve assembly including a valve head fitting over and engaging sealingly a valve seat, and a mounting device disposed inside the combustion chamber for connecting swingably the valve head to the cylinder head so that the valve head can move between a closed position in sealing engagement with the valve seat and in open position substantially out of alignment with the valve seat. A valve stem is reciprocatively journaled in the stem guide bore of the cylinder head with one end of the valve stem extending from the cylinder head and its other end connected to the valve head. The axis of the induction passage is substantially parallel to the axis of the combustion chamber so as to facilitate the flow of fluids entering into the piston cylinder. With the construction of the present invention, the valve head can swing into the piston cylinder and be disposed with its axis perpendicular to the axis of the piston cylinder when the valve head is disposed in its fully open position. As a result, the obstruction to the flow of fluids is greatly minimized and the volumetric efficiency is greatly increased. The mounting device is disposed between the induction passage and the exhaust passage so that when the valve head is disposed at its fully open position, it is located between the two passages to block any fluids flowing through the induction passage from entering the exhaust passage prematurely.

The above and still further highly important objects and advantages of the invention will become apparent from the following detailed specification, appended claims and attached drawing, wherein the drawing is a cross-sectional view of a portion of an internal combustion engine having an exhaust valve and an intake valve which is constructed in accordance with the present invention.

Referring now to the drawing, there is shown an intake valve 10, which is constructed in accordance with the present invention, and which is disposed in a cylinder block 12 of an internal combustion engine (not shown). The cylinder block 12 includes a cylinder bore 14 which defines a combustion chamber and which receives a reciprocatively mounted piston (not shown). A cylinder head 15 closes one end of the cylinder bore 14.

The cylinder head 15 closes the end of the cylinder bore 14 to completely define the combustion chamber for the piston (not shown) reciprocatively mounted therein. A vertically disposed induction passage 17 is disposed in the cylinder head and includes and terminates in an inlet or intake port 19 in the form of a valve seat. The cross-sectional shape of the valve seat may be any suitable shape, such as circular, and the cross-sectional shape of the induction passage may be any suitable shape, such as oval. Thus, the intake combustion fluids enter the combustion chamber via the induction passage 17 through the intake port 19. An inclined exhaust or outlet passage 21 disposed in the cylinder head 15 includes and terminates in an outlet or exhaust port 23 in the form of an annular valve seat. The intake valve 10 closes the valve seat of the intake port 19, and the valve seat for the exhaust port 23 is closed in a conventional manner by a poppet valve 25.

The poppet valve 25 includes a valve head 27 having a flat valve face 29. A valve stem 32 is connected to the valve back 34 and is reciprocatively mounted within a valve stem guide or bore 36, the opposite end of the valve stem (not shown) is controlled in a conventional manner. An annular bevelled seating portion 37 engages the valve seat of the exhaust port 23 to seal it as indicated in the drawings. In order to permit the exhaust gases to exit the exhaust chamber via the outlet passage 21, the valve stem 32 moves axially into the cylinder combustion chamber to move the valve face 29 into the chamber.

The plane of the valve head face 29 is inclined at an angle relative to the axis of the exhaust or outlet passage 21, and the plane of the valve face 29 is not disposed at right angles to the axis of the outlet passage 21. The axis of the valve stem 32 and its bore 36 is transverse to and disposed at an angle relative to the axis of the exhaust passage 21. The axis of the exhaust passage 21 is inclined from the vertical away from the substantially vertical axis of the induction passage 17.

The valve face 29 is planar and is of a complementary shape, such as circular, relative to the cross-sectional shape of the exhaust port 23 of the exhaust passage 21.

Considering now in greater detail the intake valve 10 with reference to the drawing, the valve 10 includes a valve head 38 of a similar shape as the shape of its valve seat. The valve head 38 is pivoted at 40 between the valve head 38 and the exhaust valve head 27, the pivot point 40 being disposed within the combustion chamber to enable the valve head 38 to swing pivotally from its closed position as shown in solid lines in the drawing to an open position shown in phantom lines at 10A downwardly within the cylinder bore 14 disposed substantially parallel to the axis of the bore 14. In its open position as shown in 10A of the drawing, the valve head 38 presents very little obstruction to the flow of fluids entering the cylinder bore 14 via the vertical induction passage 17.

The valve head 38 includes a valve face 42 of a planar configuration. A valve stem 44 is attached pivotally at 46 to the valve back 48 of the valve head 38. A valve guide or bore 53 reciprocatively receives the valve stem 44, which in turn at its opposite end (not shown) is controlled in a conventional manner to move reciprocatively to open and close the valve head 38.

Considering now the pivot connection 40 in greater detail with reference to the drawing, the pivot connection 40 includes a cylindrical hinge pin 55 integrally formed at one end of the valve head 38. The integral hinge pin 55 has its opposite ends extending beyond the body of the valve head 38 and rotatably received in a pair of oppositely disposed sockets, such as the socket 57, in a pair of oppositely-disposed blocks, such as the block 59. The blocks are mounted between the intake and exhaust valve and are fixed to the valve head by any suitable technique, such as by welding or bolting. The hinge pin 55 rotates about its axis, and as a result, the integrally connected valve head 38 also swings about the axis of the hinge pin 55.

Considering now the pivot connection 46, with reference to the drawing, the pivot connection 46 interconnects the valve stem 44 and the valve head 38. The pivot connection 46 includes a pivot pin 61 fixed to and extending between a pair of backwardly extending clevis plates, such as the plate 63 on the valve back 48. An enlarged apertured end 65 of the valve stem 44 receives rotatably the pivot pin 61 so that the end 65 can pivot about the axis of the pin 61 as the valve head 38 swings between its open and its closed positions. A valve seating portion 67 on the valve back 48 engages sealingly the valve seat of the inlet port 19 when the valve 10 is in its closed position as shown in the drawing.

The plane of the valve back 48 is inclined slightly away from a plane perpendicular to the axis of the induction passage 17 as shown in the drawing. The axis of the valve stem bore 53 extends transversely to the axis of the induction passage 17, and its cross-sectional area is substantially greater than the diameter of the valve stem 44 to enable the valve stem 44 to swing in a counterclockwise direction as viewed in the drawing as the stem moves from the passage 17 into the valve bore 14 when the valve 10 opens.

According to the invention, when the valve head 38 swings from its closed position as shown in solid lines in the drawing to its open position as shown in phantom lines as shown at 10A, the mixture of fluids flowing in the induction passage 17 into the bore 14 flows with very little obstruction by the valve head 38 due to its position within the cylinder. In the open position of the valve 10 as shown at 10A, the plane of the valve head 38 is disposed parallel to the axis of the bore 14 and is almost disposed in alignment therewith so that a high volumetric efficiency results. The intake and exhaust valve heads are disposed substantially in a common plane to provide a very compact design in the combustion side of the valve head for still greater efficiency. Also, the volumetric efficiency is greatly improved as compared to conventional induction passages and intake valves since the axis of the induction passage 17 is disposed in alignment with the axis of the bore 14 to facilitate the entrance of the fluids into the combustion chamber rather than flowing through a bent path as in conventional systems.

Also, in accordance with the present invention, the pivot connection 40 is disposed between the intake valve 10 and the exhaust valve 25 so that when the valve 10 is disposed in its open position as shown in phantom lines at 10A, the valve head 38 blocks or otherwise obstructs to a great extent the fluid entering the cylinder to prevent or at least greatly reduce the flow of the fluids out of the exhaust passage 21 during momentary valve overlaps when both valves may be open to a certain extent.

Since the pivot connection 40 is disposed within the combustion chamber, it is lubricated by compressing suitable lubricants into a plurality of holes (not shown) in the pivot connection 40 in a conventional manner to both cool the pivot connection 40 and to lubricate it.

Various changes and modifications may be made in the particular embodiment disclosed, without departing from the spirit and scope of the invention as intended to be set forth in the appended claims, for example, the materials used in the valve 10 may be varied as is well known in the art. Also, the cross-sectional shape of the induction passage 17 may be of different shapes as well as the shape of the valve head 38. Therefore, the invention is to be limited only by the spirit and scope of the invention as set forth in the appended claims.

What is claimed is:

1. In an internal combustion engine, a cylinder head including a combustion chamber and induction passage terminating at a valve seat defining an inlet port to the combustion chamber in the combustion side of the cylinder head, a stem guide bore in the cylinder head opening into the induction passage, a substantially flat valve head fitting over and engaging sealingly the valve seat;

mounting means disposed inside said combustion chamber in the combustion side of the cylinder head for connecting swingably said valve head to the cylinder block between a closed position in sealing engagement with the valve seat in a plane substantially perpendicular to the axis of the combustion chamber and a downwardly depending open position substantially parallel to the axis of the combustion chamber substantially out of alignment with said plane within said combustion chamber; and a valve stem reciprocatively journaled in said stem guide bore with one end of the valve stem extending from the cylinder head and its other end connected to said valve head for moving generally extensively reciprocatively within said stem guide bore toward and away from the combustion chamber.

2. The combination according to claim 1, wherein the axis of said induction passage extends substantially throughout its entire length in a substantially straight line and is substantially parallel to the axis of said combustion chamber for substantially the entire length of said induction passage.

3. The combination according to claim 1, wherein the plane of said valve seat is slightly inclined relative to a plane perpendicular to the axis of said induction passage.

4. The combination according to claim 1, further including an exhaust passage terminating in an exhaust valve seat defining an outlet port from said combustion chamber, exhaust valve means for opening and closing selectively said exhaust valve seat.

5. The combination according to claim 4, wherein said mounting means is disposed between the first-mentioned valve seat and said exhaust valve seat.

6. The combination according to claim 5, wherein said valve head and said exhaust valve means are disposed substantially in a common plane.

7. The combination according to claim 1, wherein the axis of said induction passage is substantially parallel to the axis of said combustion cylinder.

8. The combination according to claim 7, wherein the plane of said valve seat is slightly inclined relative to a plane perpendicular to the axis of said induction passage.

9. The combination according to claim 1, wherein said mounting means includes a pair of socket blocks downwardly depending from the combustion head inside within said combustion chamber, a hinge pin being rotatably mounted between said blocks and being integrally connected to said valve head.

10. The combination according to claim 1, wherein said valve head includes a valve back, further including a pivotal connection between one end of said valve stem and the valve back of said valve head.

* * * * *